US005809673A

United States Patent [19]

Johnson et al.

[11] Patent Number: 5,809,673

[45] Date of Patent: Sep. 22, 1998

[54] POP UP DISPLAY DEVICE

[75] Inventors: James D. Johnson; Judy M. Studenski, both of West Chicago; James J. Jacisin, Elmhurst, all of Ill.

[73] Assignee: American Slide-Chart Corporation, Carol Stream, Ill.

[21] Appl. No.: 725,965

[22] Filed: Oct. 4, 1996

[51] Int. Cl.[6] ..... G09F 1/06

[52] U.S. Cl. ..... 40/124.08

[58] Field of Search ..... 40/124.08, 124.09, 40/124.16, 539, 610, 750, 754, 100

[56] References Cited

U.S. PATENT DOCUMENTS

| | | | |
|---|---|---|---|
| D. 315,504 | 3/1991 | Labankoff . | |
| D. 360,360 | 7/1995 | Kiolbasa . | |
| 2,404,089 | 7/1946 | Pollock | 40/539 |
| 4,478,335 | 10/1984 | Long et al. . | |
| 4,634,001 | 1/1987 | Wakelin . | |
| 4,773,622 | 9/1988 | Herlin . | |
| 4,947,984 | 8/1990 | Kaufman et al. . | |
| 5,165,534 | 11/1992 | Kaufman et al. . | |
| 5,275,438 | 1/1994 | Struhl . | |
| 5,333,728 | 8/1994 | O'Brien et al. . | |
| 5,421,452 | 6/1995 | Hybiske . | |
| 5,467,547 | 11/1995 | Fortner | 40/610 |

FOREIGN PATENT DOCUMENTS

| | | | |
|---|---|---|---|
| 616783 | 1/1949 | United Kingdom | 40/539 |

OTHER PUBLICATIONS

"Dimensional Products for Dynamic Marketing"—American Slide–Chart Corp. (1992).

"Dimensional Marketing Products"—American Slide–Chart Corp. (1994).

*Primary Examiner*—C. D. Crowder
*Assistant Examiner*—Tejash D. Patel
*Attorney, Agent, or Firm*—Banner & Witcoff Ltd

[57] ABSTRACT

A display device comprising a first base panel comprising a first and a second slot, and a second base panel above the first base panel. The second base panel comprises a third and a fourth slot. The display device further comprises an opening member comprising a first opening face connecting at a first axis to a second opening face. The opening member further comprises a back face parallel to the second opening face. The opening member is connected to the first base panel at second axis, and the opening member is connected to the second base panel at a third axis. The device further comprises an elastic device cooperatively engaged between the first slot, the second slot, the third slot, and the fourth slot. The elastic device slides the first base panel along the second base panel, and the first opening face rotates along the second axis, the second opening face rotates along the first axis, and the back face rotates along the third axis.

20 Claims, 4 Drawing Sheets

POP UP DISPLAY DEVICE

FIELD OF THE INVENTION

The present invention relates to a display device for displaying objects or information. In particular, the present invention is directed to a display device that pops from a closed position to an open position.

BACKGROUND OF THE INVENTION

Display devices are useful for storing, displaying, and transporting objects and for delivering promotional messages. Display devices also serve the function of attracting the attention of targeted observers, such as recipients of promotional items sent in envelopes.

Display devices packaged in envelopes are preferably flat for ease of packaging and mailing. In addition, a display device that transforms from one position to another is more likely to attract attention, in that an observer may be interested in viewing the transformation of the device. In addition, a display device that contains an object that is hidden from view in one position may cause a curious observer to examine the device to learn what is hidden. Moreover, a display device that is self supporting is more likely to attract attention and be retained than is a display device that lays flat. It is also desirable that the display device be easy to manufacture, assemble, package and operate.

Accordingly, it is an object of the present invention to provide a display device that may be easily stored in an envelope or similar flat package. It is further an object of the present invention to provide a device that transforms from a flat closed position to an open upright position while being viewed by an observer. It is further an object of the present invention to display an object that is hidden from view when the device is closed position. Another object of the present invention is a device that remains in a upright position when open. It is further an object of the present invention to provide a display device that is manufactured from few, inexpensive parts. It is also an object of the present invention to provide a device that is straightforward to assemble and package. An additional object of the invention is a device that has few moving parts and operates in a reliable manner.

SUMMARY OF THE INVENTION

The present invention is directed to a display device comprising multiple panels, including a first base panel and a second base panel above the first base panel. The first base panel comprises a first and a second slot, and the second base panel comprises a third and a fourth slot. The display device further includes an opening member comprising a first opening face connecting at a first axis to a second opening face. The opening member further comprises a back face parallel to the second opening face. The opening member is connected to the first base panel at a second axis, and the opening member is connected to the second base panel at a third axis.

The display device further comprises an elastic device cooperatively engaged between the first slot, the second slot, the third slot, and the fourth slot. The elastic device slides the first base panel along the second base panel, causing the first opening face to rotate the second axis, and causing the second opening face to rotate along the first axis, and further causing the back face to rotate along the third axis.

The display device may also contain an opening for storing an object, such as a computer disk.

The features of the present invention may be better understood by considering the detailed description of the invention.

BRIEF DESCRIPTION OF THE DRAWINGS

In the following detailed description of the preferred and alternative embodiments, reference will be made to the accompanying drawings, wherein.

DESCRIPTION OF THE PREFERRED EMBODIMENTS

Figure 1:
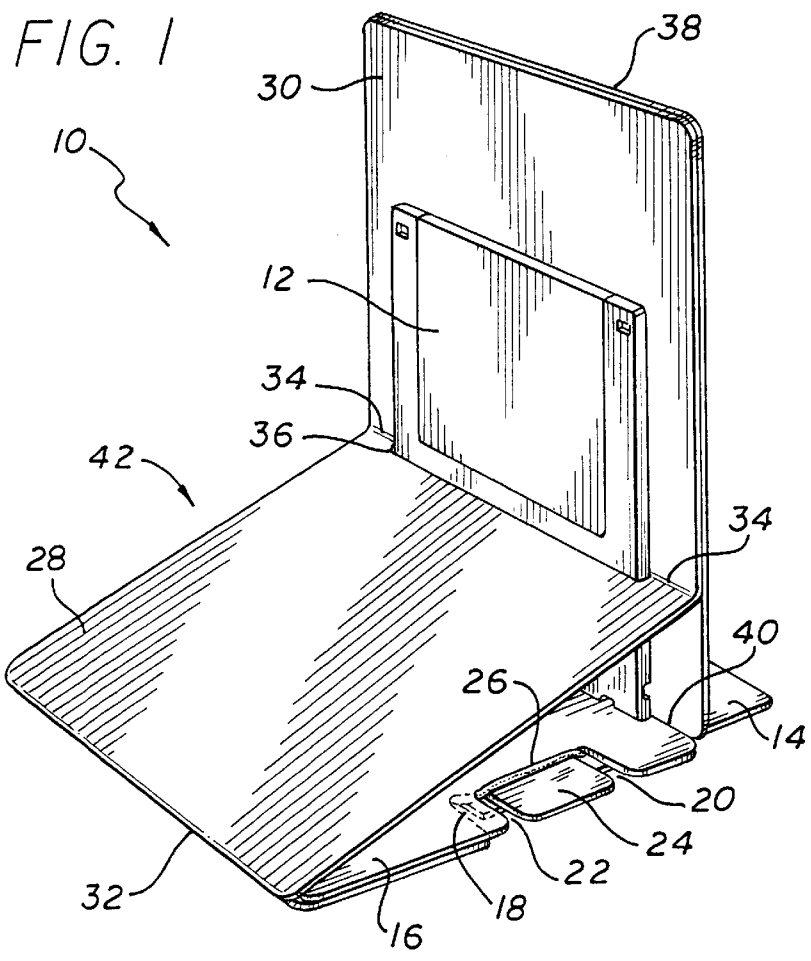
FIG. 1 is an overhead and side view of a preferred embodiment of the invention in an open position.

The present invention relates generally to a display device and more particularly to a pop up display device. Referring to FIG. 1, which is an overhead view of the invention, a display device 10 holds an object 12 such as a computer disk.

The display device 10 includes base panels 14 and 16, also referred to as horizontal members or horizontal panels. The base panel 16 may also be referred to as an inner lining. The base panel 16 is located above and slides along the base panel 14. The base panel 14 includes a slot 18. The base panel 16 includes a slot 20 and a slot 22 that define a tab 24, also referred to as a flap.

The display device 10 additionally includes an elastic device or member 26, also referred to as an elastic biasing device, that is engaged in the slots 20 and 22, as well as the slot 18. The elastic device 26 is preferably a common rubber band.

The display device 10 further includes additional panels or opening faces 28 and 30. The opening face 30 is also referred to as a front portion. The base panel 14 is hingedly connected to the opening face 28 along a crease 32, also referred to as a fold or a foldline. The opening face 28 is hingedly connected to the opening face 30 along a crease 34, also referred to as a fold or a foldline. Along the crease 34, where the opening face 28 meets the opening face 30, is preferably an opening 36, also referred to as a slot or a bore, that receives the object 12. In another embodiment, the opening 36 may be located elsewhere along the opening face 28. As is appreciated by one skilled in the art, an object may also be positioned or attached to the device in alternative manners. In yet another embodiment, there is no opening or slot 36 and the device does not store an object.

The opening face 30 is connected to a panel 38, also referred to as a back panel, back face or back member or back portion, that extends to the base panel 16. The back face 38 is parallel to the opening face 30, and the back face 38 together with the front portion 30 cooperatively define an upper panel. The back face 38 hingedly connects to the base panel 16 at a crease 40, also referred to as a fold or foldline. The opening faces 28 and 30 and the back face 38 define an opening member 42. In a preferred embodiment, advertisements or other information may appear on the panels 28, 30 and 38.

Figure 2:
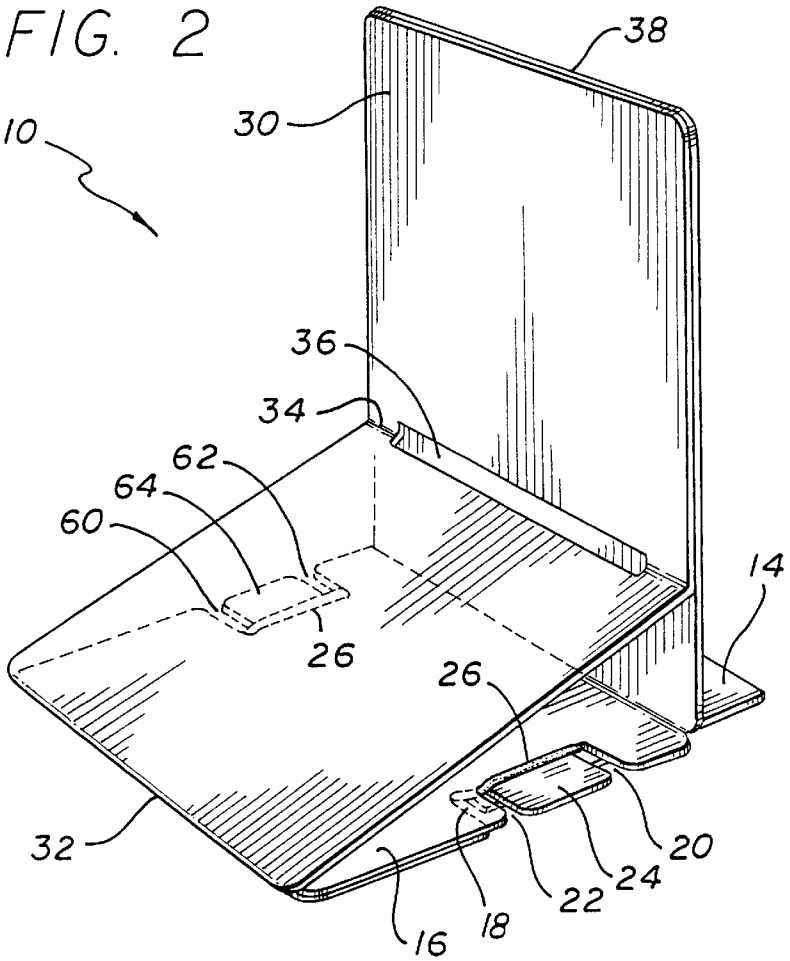
FIG. 2 is a perspective similar to FIG. 1 with more of a side view of the invention shown in FIG. 1.

Further details of the invention are seen in FIG. 2, a view of the display device 10 from more of a side perspective than FIG. 1. The object 12 is also not shown in FIG. 2.

As seen in FIG. 2, the base panel 16 includes slots 60 and 62. The slots 60 and 62 define a tab 64, also referred to as a flap. The elastic device 26 stretches along the underside of the base panel 16 and above the base panel 14, and between the slots 20 and 62.

Figure 3:
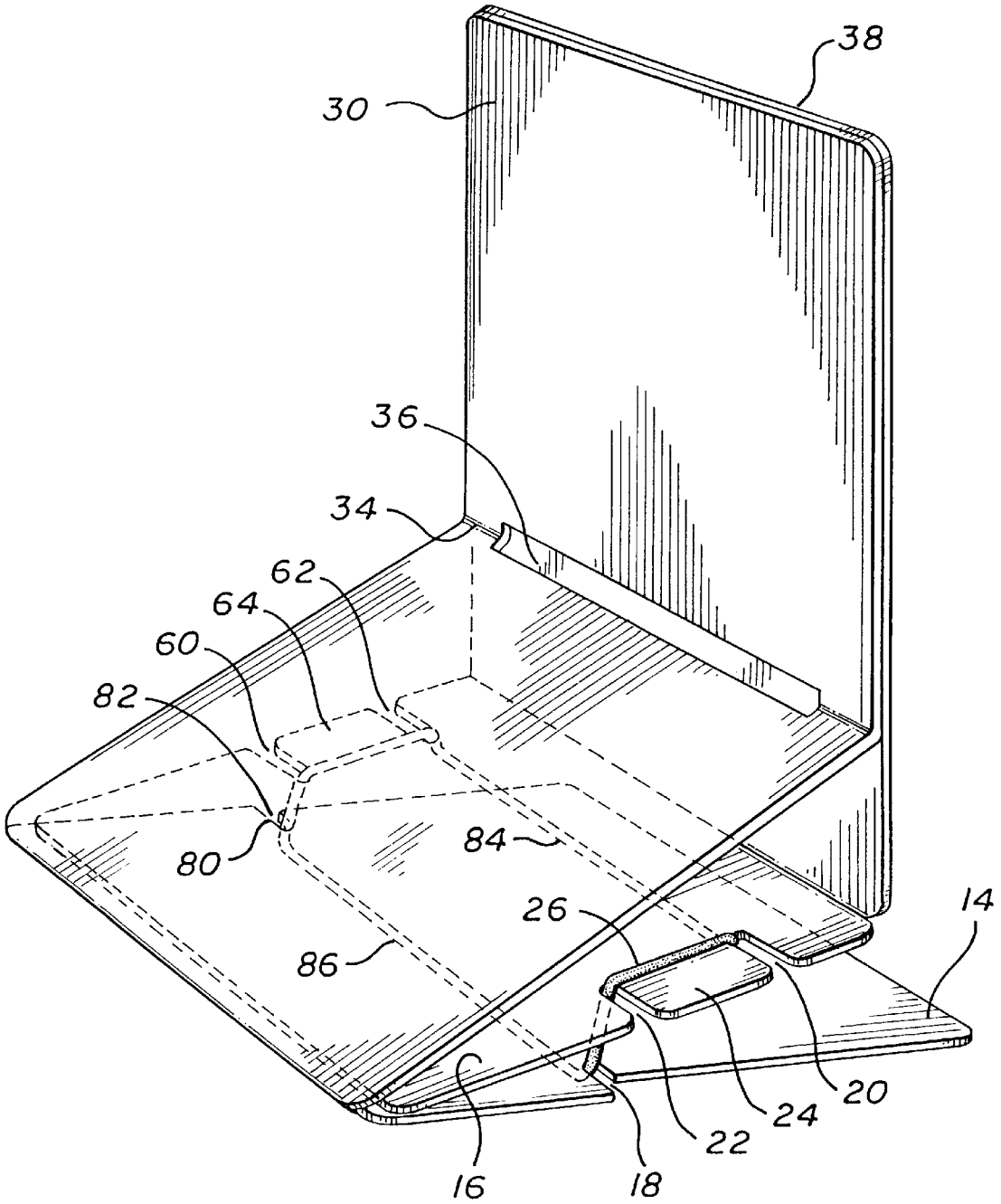
FIG. 3 is a side view similar to that of FIG. 2, where dashed and dotted lines indicate aspects of the invention hidden from view in FIG. 2.

FIG. 3 shows further details of what is hidden in FIG. 2. The dashed line at 80 shows the perimeter of the base panel 14 that is hidden by the base panel 16. As is seen, the base panel 14 includes a slot 82.

The dotted lines 84 and 86 depict the elastic device 26 that is hidden from view by the base panels 14 and 16. The dotted line 84 shows the elastic device 26 stretching from the underside of the base panel 16 from the slot 20 to the slot 62. The elastic device 26 shown by the dotted line 84 is below the base panel 16 and is above the base panel 14. The dotted line 86 shows the elastic device 26 stretched from the slot 18 to the slot 82. The elastic device 26 shown by the dotted line 86 is below the base panel 14.

Figure 4:
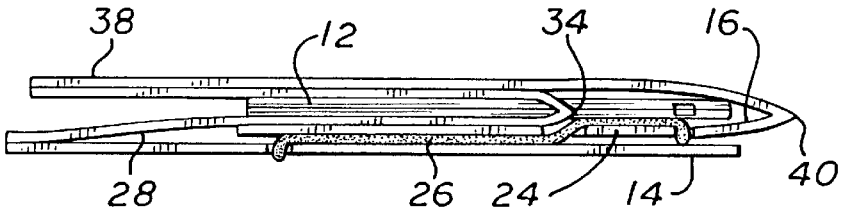
FIGS. 4–6 are a sequence of side views of a preferred embodiment of the invention from the display device in a flat position (FIG. 4) to the display device in a partially open position (FIG. 5) to the display device in an open position (FIG. 6)

FIGS. 1–3 show the invention in an open position. Turning to FIG. 4, the display device 10 is seen in a side view in the closed position. As is seen, the panels 14, 16, 28 and 38 are all substantially horizontal. The display device opens as shown in the side views of FIGS. 5 and 6. FIG. 6 shows the display device 10 in the open position as in FIGS. 1–3.

The device does not naturally remain in the position shown in FIG. 4 due to the bias applied by the elastic device 26. When the device is in the closed position as in FIG. 4, the elastic device 26 is stretched between the base panel 14 and the base panel 16. Specifically, the elastic device 26 is attached to the base panel 16 at the slots 20, 22, 60 and 62 and is also attached to the base panel 14 at the slots 18 and 82. Due to its elastic nature, the stretched elastic device 26 pulls the horizontal member 16 along the base panel 14 until an end 88 of the base panel 16 is pulled toward and rests against the crease 32, as seen in FIG. 6. As is seen in FIG. 4, the elastic device 26 is stretched when the device is closed. As the device opens, the elastic device contracts and pulls the base member 16 toward the crease 32.

Thus, in order for the display device 10 to remain the closed position, a force must be applied to the top of the device, for example, along the back face 38. Such a force is applied, for example, when the device is inside an envelope (not shown). As the device slides out of the envelope, it opens as shown in FIGS. 5 and 6.

Figure 5:
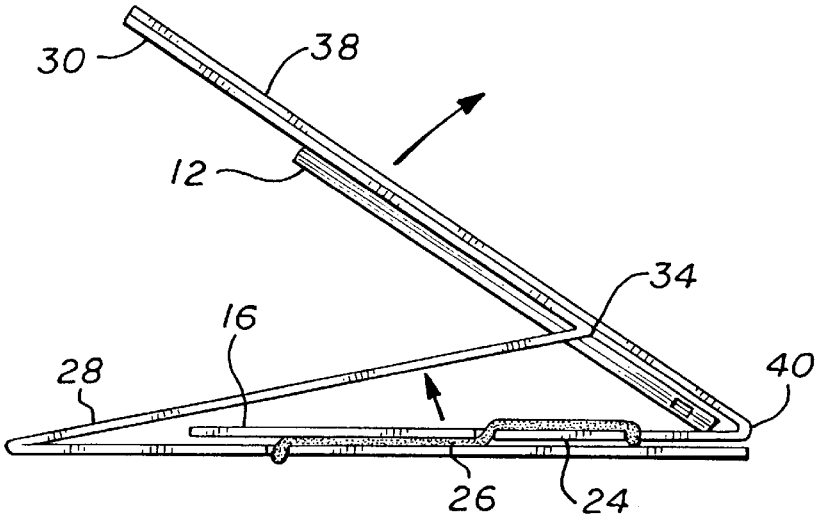
Figure 6:
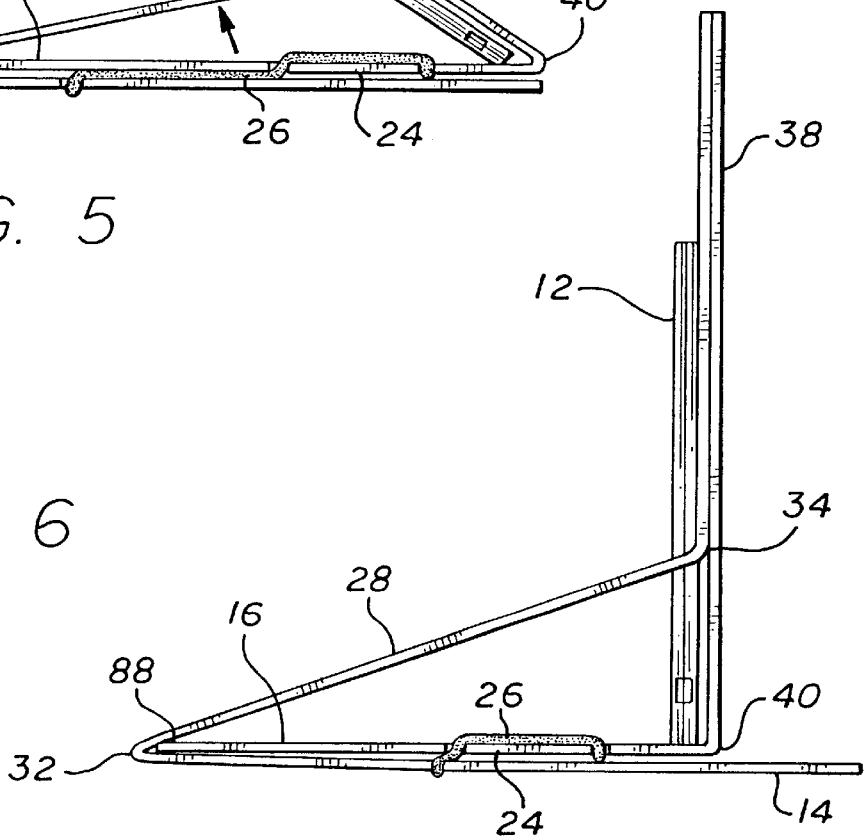

As is appreciated from viewing FIGS. 4, 5 and 6, the creases 32, 34 and 40 each define an axis about which the various panels rotate. For example, the back face 38 rotates about the axis defined by the crease 40 as indicated by the upper arrow in FIG. 5. As is seen in FIG. 4, the back face 38 is located in a substantially horizontal position and rotates to an upright substantially vertical position, as seen in FIG. 6. Similarly, the opening faces 28 and 30 rotate about the axis defined by the crease 34. The opening face 28 also rotates about the crease 32.

Figure 7:
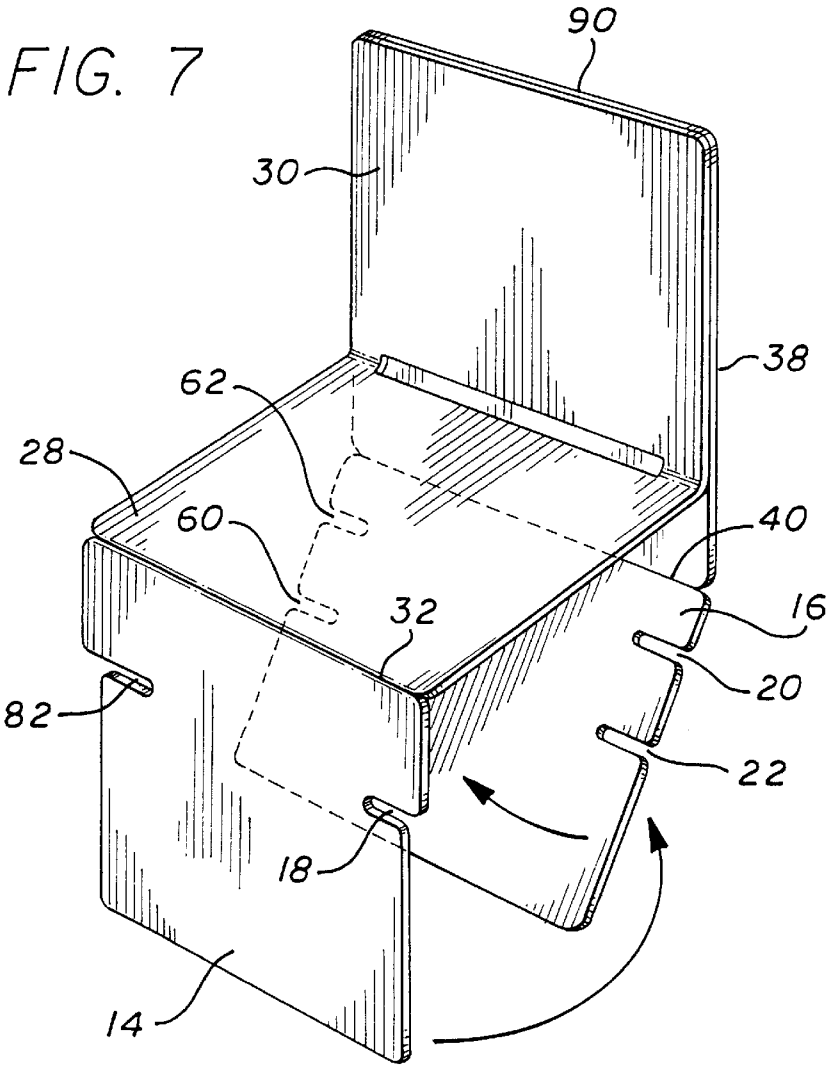
FIG. 7 is an overhead view of a preferred embodiment of the invention, similar to the perspectives of FIGS. 1–3, where the display device is unassembled.

Details of the invention may be further appreciated by reference to FIG. 7, a perspective similar to that shown in FIG. 1. FIG. 7 illustrates the unassembled display device 10 with the elastic device 26 removed. In addition, in FIG. 7, the base panels 14 and 16 are not horizontal because, for illustration purposes, the device is assumed to not be resting on a typical horizontal surface. FIG. 7 illustrates the slots 18 and 82 of the base panel 14 and the slots 20, 22, 60 and 62 of the base panel 16. As shown by the arrows, to assemble the device, the base panel 14 is rotated about the crease 32 so that it is beneath the base panel 16, which is rotated about the crease 40. The elastic device 26 is then attached.

Figure 8:
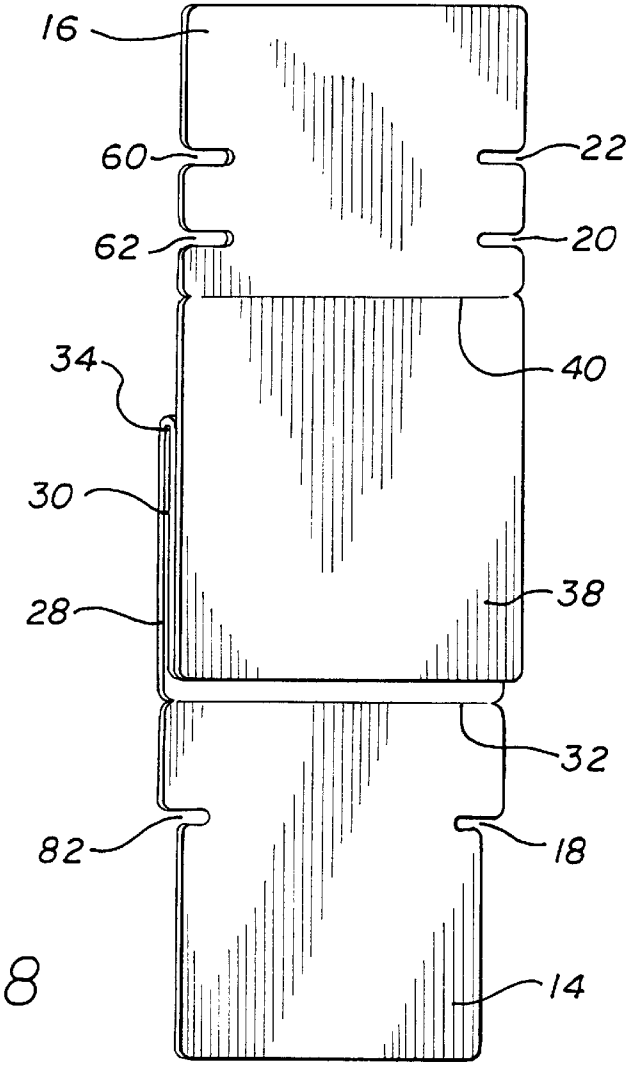
FIG. 8 is a view of the underside of a preferred embodiment of the invention where the display device is unassembled.

The underside of the display device 10 is shown in FIG. 8. For example, this figure shows the back face 38 of the display device 10. As can be appreciated from FIGS. 7 and 8 the device may consist of a single piece of material. Referring to FIG. 7, the panel 30 is hingedly connected to the panel 38 along a crease 90. The device may also consist essentially of two pieces of material, specifically, one piece of material that consists of the panels 14, 28 and 30 and a second piece of material consists of the panels 38 and 16. The two panels 30 and 38 are attached by an adhesive.

The display device may be produced in various shapes, for example, cubes, pyramids, hexagons, canisters, telephones, houses, building shapes and product replicas. The display device is suitable for various storage and promotional uses by manufacturers, wholesalers, real estate organizations, the travel industry, financial institutions, business services, fund raisers, and membership organizations.

It is to be understood that the specific embodiments that have been described are merely illustrative of a preferred application of the principles of the invention. Numerous modifications, additions and substitutions may be made to the embodiments shown and described without departing from the true spirit and scope of the invention. By way of just one example, the display device does not necessarily include a slot or an opening for holding an object. As another example only, the invention is not limited to the configuration of the slots or the number of slots shown. The spirit and scope of the invention is defined in the appended claims, to be interpreted in light of the foregoing specification.

We claim:

1. A display device, having an open position and a closed position, comprising:

a first base panel comprising a first and a second slot;

a second base panel above said first base panel, said second base panel comprising a third and a fourth slot;

an opening member comprising a first opening face connecting at a first axis to a second opening face, said opening member further comprising a back face parallel to said second opening face, said opening member connected to said first base panel at a second avis, said opening member connected to said second base panel at a third axis;

an elastic device cooperatively engaged between said first slot, said second slot, said third slot, and said fourth slot, such that when said display device is being held closed by a closing force and said closing force is removed said elastic device contracts thereby causing said first base panel to slide about said second base panel, said first opening face to rotate about said second axis, said second opening face to rotate about said first axis, and said back face to rotate about said third axis thereby opening said display device.

2. A display device as in claim 1 wherein said first opening face is substantially horizontal when said display device is closed.

3. A display device as in claim 2 wherein said second opening face and said back face are substantially horizontal when said display device is closed.

4. A display device as in claim 3 wherein said second opening face and said back face are substantially vertical when said display device is open.

5. A display device as in claim 3 wherein said elastic device is a rubber band.

6. A display device as in claim 5 wherein said opening member comprises an opening for storing an object.

7. A display device as in claim 6 wherein said first opening face and said second opening face cooperatively define said opening.

8. A display device as in claim 7 wherein said opening is adapted to hold a computer disk.

9. A display device as in claim 5 wherein said second base panel includes a fifth slot and a sixth slot and said elastic device is cooperatively engaged in said fifth slot and said sixth slot.

10. A display device as in claim 1 wherein said display device is made of cardboard.

11. A display device, having an open position and a closed position, comprising:

a first base panel flexibly connected at a first crease to a first exposure panel, said first exposure panel flexibly connected to a second exposure panel at a second crease;

a back panel connected to said second exposure panel, said back panel flexibly connected with a second base panel at a third crease, said second base panel including an end;

a first axis defined by said third crease, said back panel rotating about said first axis;

a second axis defined by said second crease, said second exposure panel rotating about said second axis;

an elastic coupling said first base panel to said second base panel such that, upon removal of a closing force from said display device, while said display device is in said closed position, said elastic device pulls said second base panel along said first base panel until said end rests against said first crease, said back panel rotates about said third axis from a substantially horizontal position, said second exposure panel rotates about said second axis from a substantially horizontal position thereby opening said display device.

12. A display device as in claim 11 wherein said base panel includes a first slot and a second slot, said second base panel includes a third slot and a fourth slot, and said elastic device is engaged in said first slot, said second slot, said third slot, and said fourth slot.

13. A display device as in claim 12 wherein said second base panel includes a fifth slot and a sixth slot, and said elastic devices is engaged in said fifth slot and said sixth slot.

14. A display device as in claim 11 wherein said elastic device is a rubber band.

15. A display device as in claim 13 wherein, while said display device is opening from said closed position, said back panel rotates from a substantially horizontal position to a substantially vertical position and said second exposure member rotates from a substantially horizontal position to a substantially vertical position.

16. A pop up holder having an open position and a closed position comprising:

an upper panel having a front portion and a back portion, said front portion mounted to said back portion;

a front panel hingedly connected to said front portion of said upper panel;

a first foldline at a junction between said front portion of said upper panel and said front panel;

a base panel having a first slot and a second slot, said base panel hingedly connected to said front panel at a second foldline;

an inner lining portion having a first flap and an end;

a third foldline at a junction between said back portion and said inner portion; and an elastic biasing device stretchably connected to said first slot and said second slot in said base panel, said elastic biasing cooperating with said base panel and said inner lining portion and, upon removal of a closing force from said pop up holder, while said pop up holder is in said closed position, sliding said end of said inner lining portion toward said second foldline and opening said pop up holder.

17. A pop up holder as in claim 16 further comprising a bore in said first foldline, said bore being adapted to hold an object.

18. The pop up holder of claim 16 further comprising a bore in said front panel.

19. The pop up holder of claim 16 further comprising a bore in said front portion of said upper panel.

20. The pop up holder of claim 16 wherein said elastic biasing device is a rubber band.

* * * * *